United States Patent [19]

Fenn et al.

[11] Patent Number: 4,727,996

[45] Date of Patent: Mar. 1, 1988

[54] VARIABLE GRIP LIFTING MECHANISM

[75] Inventors: Ronald L. Fenn, Hudson; Tim Abblett, Alliance; John Sanor, Kensington, all of Ohio

[73] Assignee: AMCA International Corp., Hanover, N.H.

[21] Appl. No.: 887,289

[22] Filed: Jul. 21, 1986

Related U.S. Application Data

[63] Continuation of Ser. No. 503,533, Jun. 13, 1983, abandoned.

[51] Int. Cl.[4] ..... B66C 17/12

[52] U.S. Cl. ..... 212/213; 901/34; 414/730

[58] Field of Search ..... 212/205, 206, 209, 213, 212/220, 221, 225, 127–129; 901/32, 34, 37; 414/730

[56] References Cited

U.S. PATENT DOCUMENTS

| | | | |
|---|---|---|---|
| 520,798 | 6/1894 | Morgan et al. | 212/129 |
| 2,952,432 | 10/1960 | Schorel | 212/129 |
| 3,064,324 | 11/1967 | Schaper | 212/129 |
| 3,097,875 | 7/1963 | Kaplan | 294/67 |
| 3,199,910 | 8/1965 | Bradley | 294/88 |
| 3,260,375 | 7/1966 | Lemelson | 212/127 |
| 3,422,967 | 1/1969 | Aron | 901/32 |
| 3,509,583 | 5/1970 | Fraioli | 3/1.1 |
| 3,759,563 | 9/1973 | Kitamura | 294/88 |
| 3,865,424 | 2/1975 | Jabkowski | 901/37 |
| 3,904,234 | 9/1975 | Hill et al. | 294/106 |
| 3,945,676 | 3/1976 | Asamoto | 294/88 |
| 3,952,880 | 4/1976 | Hill et al. | 901/34 |
| 4,012,938 | 3/1977 | Brandstrom | 901/37 |
| 4,024,959 | 5/1977 | Grung | 901/34 |
| 4,087,083 | 5/1978 | Kozuka et al. | 901/34 |
| 4,132,318 | 1/1979 | Wang et al. | 214/1 BB |

FOREIGN PATENT DOCUMENTS

| | | | |
|---|---|---|---|
| 1172013 | 6/1964 | Fed. Rep. of Germany | 212/129 |
| 1188782 | 3/1965 | Fed. Rep. of Germany | 212/127 |
| 2252297 | 5/1974 | Fed. Rep. of Germany | 212/127 |

OTHER PUBLICATIONS

IBM Technical Disclosure Bulletin, vol. 20, No. 7, Dec. 1977.

*Primary Examiner*—Joseph F. Peters, Jr.
*Assistant Examiner*—Stephen P. Avila
*Attorney, Agent, or Firm*—Renner, Otto, Boisselle & Lyon

[57] ABSTRACT

A grab assembly for handling articles such as hot and cold steel ingots and molds, characterized by multiple current relays and limit switches that enable selection of different grip forces. The assembly comprises complemental tongs, an electrically powered drive for actuating the tongs and compressing springs which resiliently restrain the tongs in gripping engagement with an article, an electrically operated holding brake for maintaining such resilient restraint of the tongs, and a selector for rendering operative any one relay and corresponding limit switch which redundantly operate to stop the powered drive and set the holding brake in response to motor current and spring compression reaching respective predetermined amounts corresponding to a respective desired gripping force at the tongs. Also disclosed is a crane employing the grab assembly.

19 Claims, 7 Drawing Figures

VARIABLE GRIP LIFTING MECHANISM

This is a continuation of co-pending application Ser. No. 503,533 filed on June 13, 1983, now abandoned.

DISCLOSURE

This invention relates in general to cranes, and in particular to grab assemblies suspended by cranes for hoisting and transporting massive articles such as steel ingots and molds. More particularly, the invention relates to variable grip lifting mechanisms that engage the sides of the articles being lifted with variable, selectable gripping force.

BACKGROUND

Cranes having grapples or grab mechanisms heretofore have been used to transport massive articles such as steel or aluminum ingots at the smelter, steel mill or fabricating facilities. Typically, the grab assembly is carried by the crane and may be lowered into proper position to pick up the article between a pair of tongs. Due to the great weight of these articles, which may be many thousands of pounds, the tongs have been outfitted with tong bits or jaws to obtain positive gripping or engagement with the sides of the article within acceptable size and power requirements of the motor and drive train assemblies used to operate the tongs.

At some sites such as at soaking pits in steel manufacturing facilities, there may be a need to transport both hot and cold ingots as well as ingot molds. When hoisting a cold ingot or bloom, large or high gripping force is required to obtain a secure grip on the hard cold steel whereas a lower gripping force should be used when handling a hot ingot to reduce tong bit indentation of the relatively soft metal. Furthermore, the gripping force should be even less when handling a mold with pick-up lugs to minimize damage to the mold. Accordingly, it would be desirable and it is a principal object of this invention to provide a variable grip lifting mechanism which provides for variable, selectable gripping forces at the tong bits.

SUMMARY OF THE INVENTION

A crane that employs the variable grip lifting mechanism of the type hereinafter described can be used to handle massive articles having different material and/or constructional characteristics. In particular, the lift mechanism is characterized by multiple current relays and limit switches that enable selection of high, medium or low grip force at its tong bits or jaws to obtain positive gripping of cold ingots, hot ingots or molds, respectively, while minimizing indentation or damage to such articles.

Generally stated, the invention provides a gripping mechanism, for use in lifting and/or handling articles, comprising complemental article engaging members mounted for movement towards and away from one another, powered means for relatively moving such members forceably to grip an article, holding means operable to maintain applied gripping force, multiple limit means operable to effect such operation of the holding means in response to gripping force reaching respective predetermined values, and selector means for rendering operative any selected one of the limit means, whereby the gripping force may be limited to and maintained at the predetermined value corresponding to the then selected one of the limit means. More particularly, the powered means and holding means respectively include an electric motor and an electrically operated brake, and the multiple limit means include respective relay means selectively operably connectable in circuit with said motor by the selector means for monitoring motor current and effecting operation of the brake in response to motor current reaching respective levels corresponding to the respective predetermined values of gripping force.

Further in accordance with the invention, the motor may operate to compress springs which resiliently restrain the article engaging members in gripping engagement with the article, and there may be provided multiple limit switch means mechanically actuatable in response to respective degrees of compression of the spring means. Each limit switch means is selectively operably connectable by the selector means to the holding means for effecting operation thereof upon actuation. For redundant grip force control, the selector means renders operative any one relay means and a corresponding limit switch means which, independently of one another, will stop the powered means and operate the holding brake at then selected grip force.

Further stated, the invention provides a grab assembly for use in lifting articles such as steel ingots and molds, comprising a support frame, a pair of complemental tongs having tong bits at their lower ends, means suspending the tongs beneath the frame for inward and outward movement at their tong bits, powered drive means for inwardly moving the tongs to grip an article therebetween at the tong bits and for outwardly moving the tongs to open the tong bits, holding means operable to maintain applied gripping force at the tong bits upon stoppage of the drive means, a set of limit means operable to stop the drive means and effect operation of the holding means in response to gripping force reaching respective predetermined values, and selector means for rendering operative any selected one of the limit means.

Still further stated, the invention provides a crane for transporting articles such as steel ingots or molds, comprising an overhead support mounted for horizontal movement along tracks, a plurality of cables depending from the support, a support frame suspended by the cables, a pair of complemental tongs having tong bits at their lower ends, means suspending the tongs beneath the frame for inward and outward movement at their tong bits, powered drive means for inwardly moving the tongs to grip an article therebetween at the tong bits and for outwardly moving the tongs to open the tong bits, holding means operable to maintain applied gripping force at the tong bits upon stoppage of the drive means, a plurality of limit means operable to interrupt the drive means and effect operation of the holding means in response to gripping force reaching respective predetermined values, and selector means for rendering operative any selected one of the limit means.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 6 is a schematic diagram of an electrical control circuit for the grab assembly of FIG. 3.

DETAILED DESCRIPTION

Figure 1:
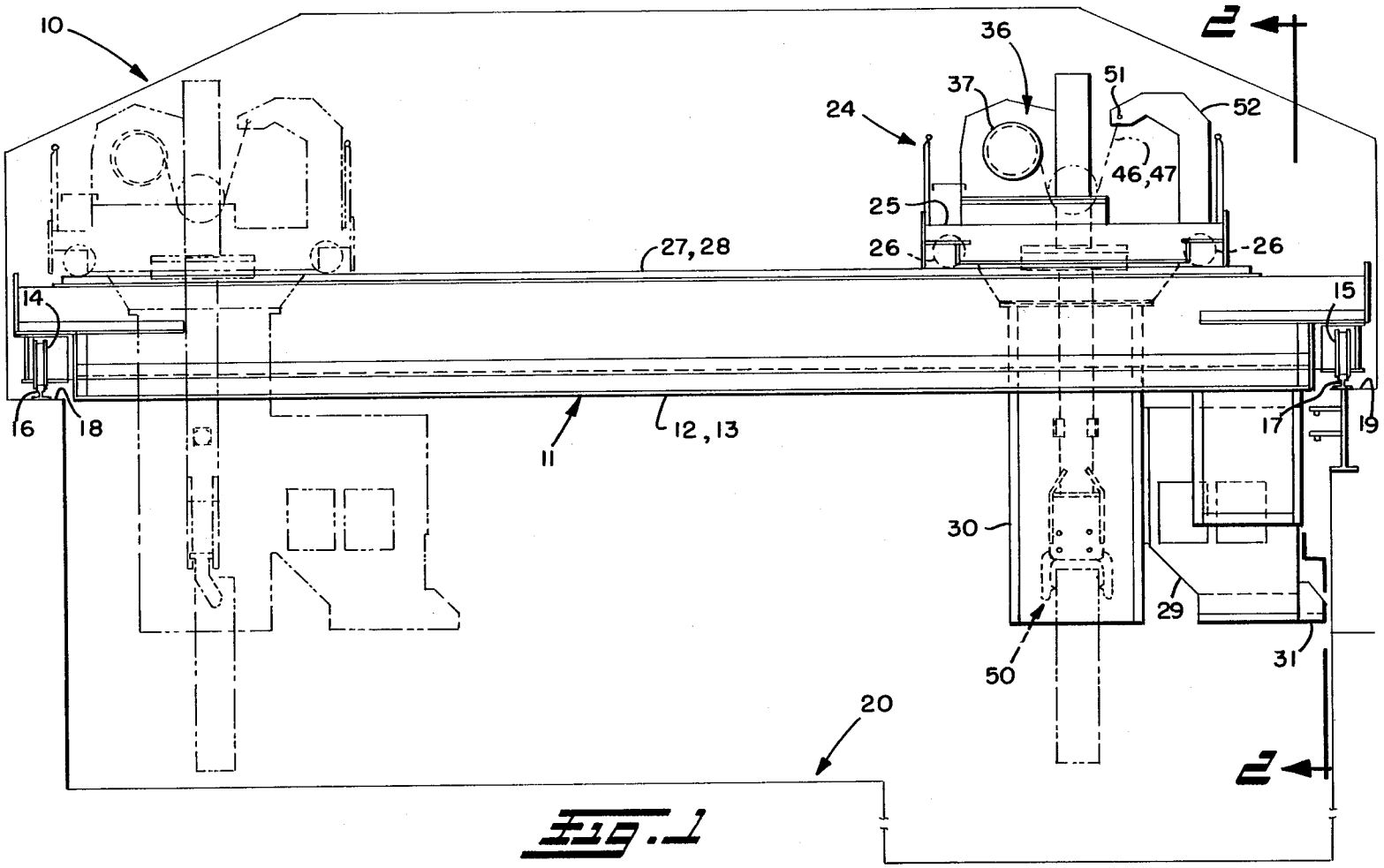
FIG. 1 is a front elevational view of a crane embodying the present invention in a particular form.
Figure 2:
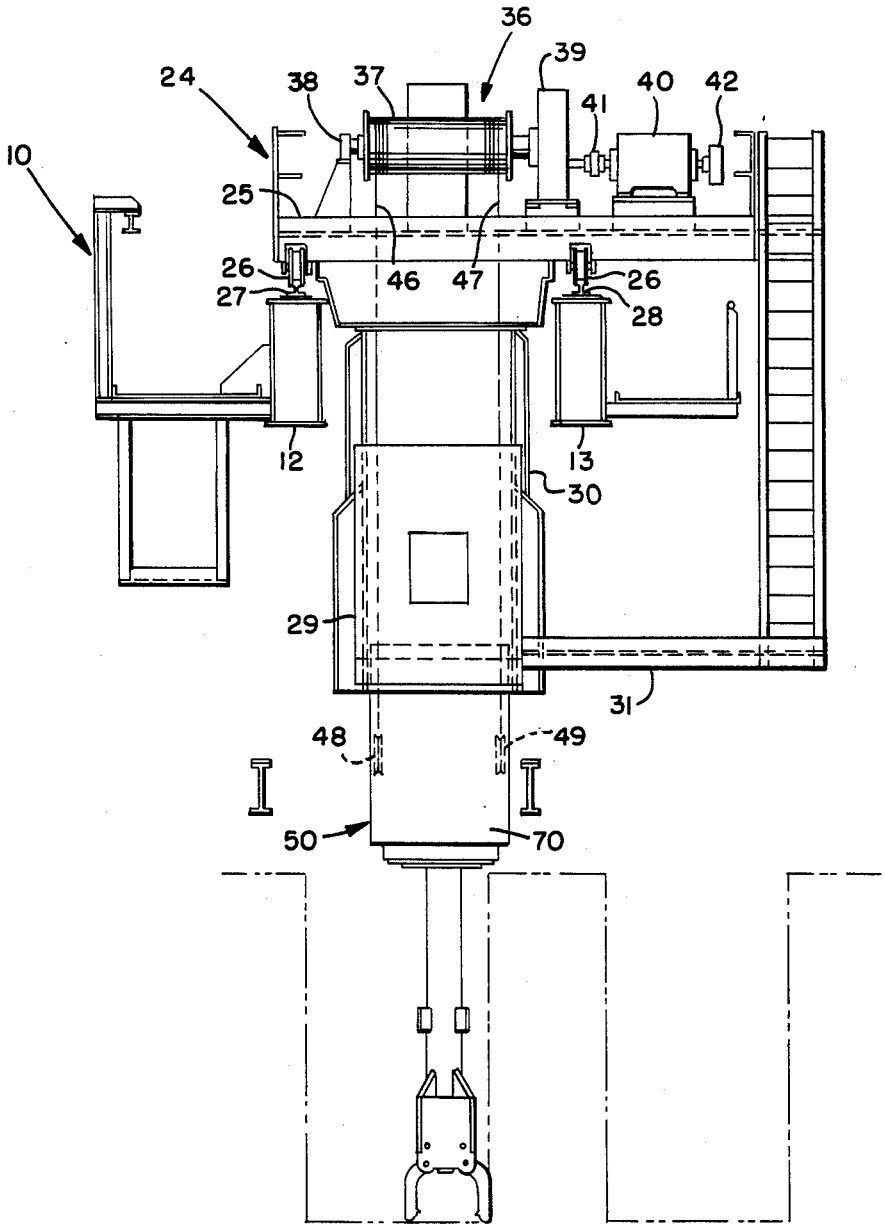
FIG. 2 is an enlarged end elevational view of the crane, as seen from and partly sectioned along the line 2—2 of FIG. 1.

Referring now in detail to the drawings and initially to FIGS. 1 and 2, an overhead bridge-type traveling crane is indicated generally by reference numeral 10. The crane comprises a horizontal bridge 11 fabricated from welded structural members including two spaced parallel girders 12 and 13. The girders are supported at their opposite ends by wheel assemblies 14 and 15 which engage and ride along parallel tracks 16 and 17 mounted on overhead building structures 18 and 19, respectively. The bridge may span, for example, a soaking pit facility schematically shown at 20, and is horizontally movable thereover by suitable means such as operator controlled reversible electric bridge travel motors (not shown).

The crane 10 also comprises a trolley 24 which includes a horizontal rectangular base frame 25. The base frame 25 is supported at its four corners by respective wheels 26 which engage and ride along parallel tracks 27 and 28. The tracks 27 and 28 are mounted atop and along the girders 12 and 13, respectively, and extend at right angles to the tracks 16 and 17. The trolley is horizontally movable along such tracks 27 and 28 (between its solid line and phantom line positions in FIG. 1) by suitable means such as an operator controlled reversible electric motor (not shown), and horizontal movements of the trolley lengthwise along the bridge as well as horizontal movements of the bridge at right angles thereto are controlled from an operator cage 29 which is mounted to one side of a vertically oriented grab housing 30 which is centrally fixedly suspended from the base frame 25 of the trolley. The operator cage provides a central location for all controls and control panels necessary to activate and control each and every movement of the bridge, trolley and below described grab assembly. As seen at the right in FIGS. 1 and 2, convenient access may be had to the operator cage by means of a boarding platform 31.

The trolley 24 is provided with a block and tackle hoist or lift mechanism designated generally by reference numeral 36. The hoist mechanism includes a horizontally oriented lifting barrel or drum 37 which is rotatably mounted at one end in a pillow block 38 and rotatably supported and driven at its other end by a gear reducer 39. The pillow block and gear reducer are mounted on the trolley base frame 25 along with a reversible electric grab lift motor 40 which is rotatably connected to the gear reducer by coupling 41. Also rotatably connected to the motor 40 is an electrically operated grab lift holding brake 42.

The lift mechanism also includes a pair of cables 46 and 47 which have one end fixed to and wrapped onto the drum 37. From the drum, the cables extend downwardly to respective sheaves 48 and 49 which are rotatably mounted in and at opposite sides of a grab assembly or gripping mechanism designated generally by reference numeral 50. Each cable is trained about its respective sheave and then extends upwardly to its point of connection 51 on a respective anchor arm 52 mounted on the trolley base frame 25. Accordingly, rotation of the drum in one direction will take up the cables and hoist the grab assembly whereas rotation in the other direction will pay out the cables to lower the grab assembly.

Figure 3:
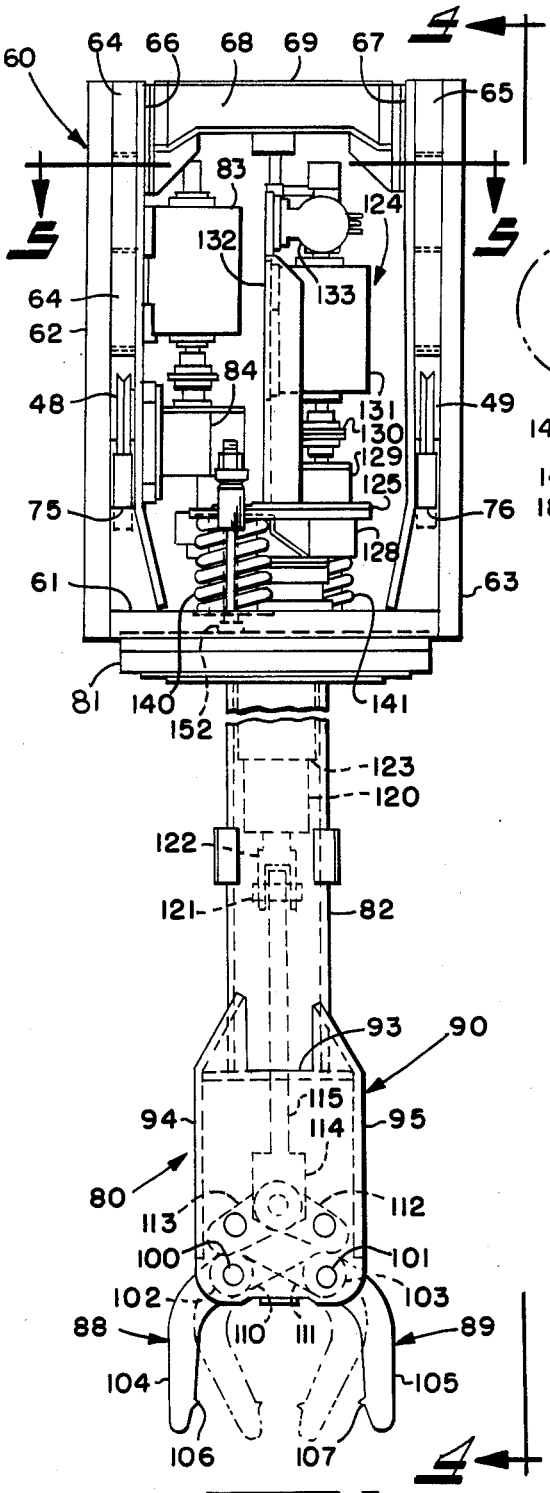
FIG. 3 is an enlarged, fragmentary front elevational view of the grab assembly embodied in the crane of FIG. 1.
Figure 4:
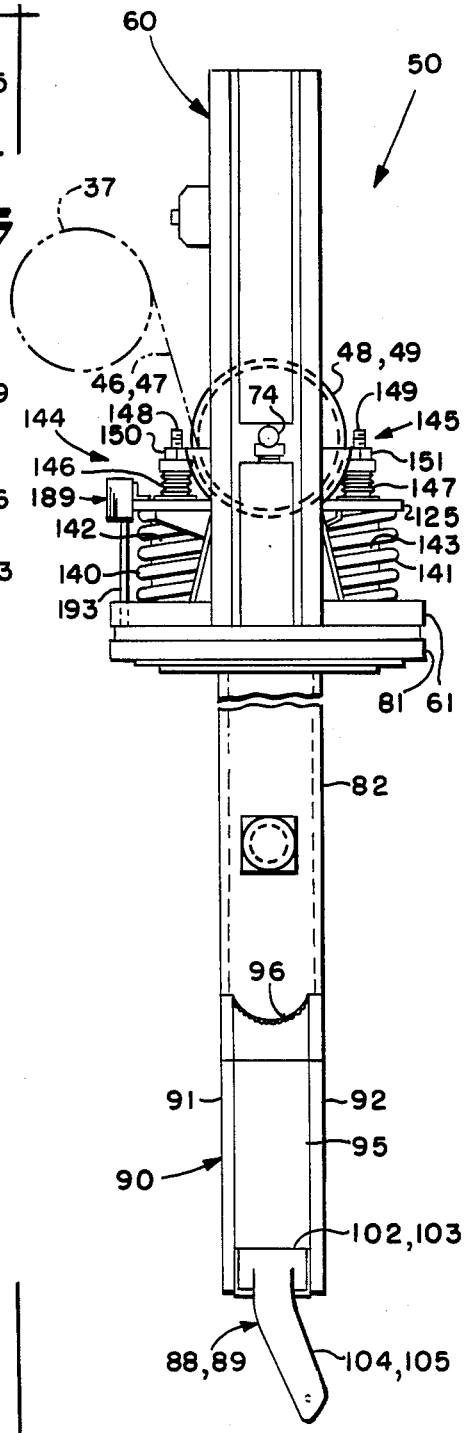
FIG. 4 is a fragmentary side elevational view of the grab assembly of FIG. 3 as seen from the line 4—4 thereof.
Figure 5:
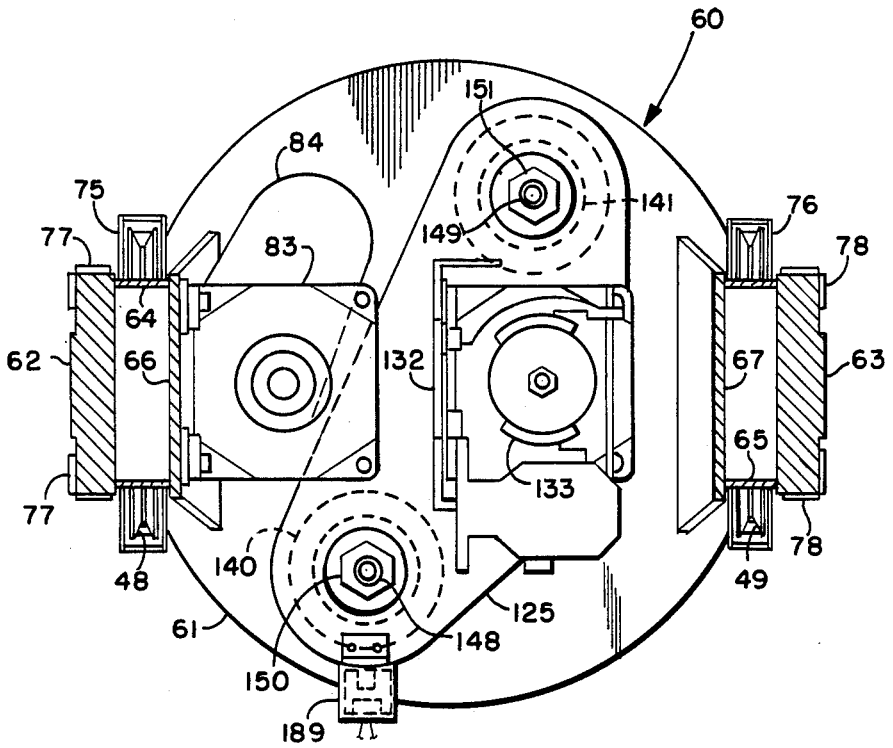
FIG. 5 is an enlarged sectional view through the grab assembly of FIG. 3 taken along the line 5—5 thereof.

In FIGS. 3-5, the grab assembly 50 can be seen to comprise a fabricated frame 60 which has a horizontal circular bottom plate 61 fixed to the lower ends of vertically elongate outer side plates 62 and 63. Respectively secured by pairs of vertically spaced spacer plates or blocks 64 and 65 to the outer side plates are inner side plates 66 and 67 which are interconnected at their upper ends by a horizontal tie beam 68. A top cover 69 may be fixed atop the tie beam and a cylindrical side cover 70 may be mounted to and around the frame 60 to shield interior components of the grab assembly from exterior environmental conditions.

The outer side plates 62 and 63 and the respective inner side plates 66 and 67 are parallel for the most part and spaced to accommodate therebetween the cable sheaves 48 and 49, respectively. Each sheave is rotatably mounted as by bearings on a respective short shaft 74 fixed to and between respective inner and outer side plates. Beneath the sheaves 48 and 49, there may be provided respective semi-circular cable guides 75 and 76 that keep the cables 46 and 47 trained about the sheaves. It also is noted that the outer side plates 62 and 63 are guided for vertical movement in respective vertical channels formed on inside walls of the grab housing 30 and may be provided with wear plates 77 and 78 as seen in FIG. 5.

The grab assembly further comprises a tong assembly 80 which is rotatably attached to and suspended below the bottom plate 61 by a rotate bearing assembly 81. The rotate bearing assembly is disposed between the frame 60 and a cylindrical tong mount extension housing 82 which is rotatable about its axis by a reversible electric tong rotate motor 83. The tong rotate motor is mounted to the inner side plate 66 and is drivingly connected to the extension housing 82 by a suitable gear reducer and coupling assembly 84. By operation of the tong rotate motor, the tong assembly 80 may be rotated on its vertical axis in either direction of rotation.

The tong assembly 80 comprises a pair of tongs 88 and 89 which are pivotally mounted in a generally rectangular tong mount housing 90 fixed to and extending beneath the extension housing 82. The housing 90 includes vertical side plates 91 and 92 each having a top cut-out 93 for receipt of the extension housing 82 and chordal abutment against the bottom of such housing. The side plates are fixed to and spaced by vertical end plates 94 and 95 and each end plate has an inwardly and upwardly inclined upper end portion fixed to the extension housing at a curved cut-out 96.

The tongs 88 and 89 are swingingly mounted in the housing 90 at points intermediate their ends by respective pivot pins 100 and 101 which are fixed to and extend between the housing side plates 91 and 92 in horizontally spaced parallel relation. The tongs rotate on their pivot pins by means of suitable bearings housed in respective bearing collars 102 and 103 which additionally serve to horizontally locate the tongs for swinging movement in a common vertical plane. Depending from the bearing collars, the tongs have respective gripping arms 104 and 105 provided with inwardly extending tong bits 106 and 107 at their distal ends. The gripping arms are complemental and, as seen in FIG. 4, may be correspondingly bent out of the vertical plane of tong swinging movement.

At their upper ends, the tongs 88 and 89 have respective inwardly directed pivot arms 110 and 111 which are pivotally connected at their distal ends to the lower ends of respective toggle links 112 and 113. The toggle links in turn are pin connected at their other or upper ends to a block 114 which is fixed to the bottom end of a tong actuator rod 115. As seen in FIG. 3, the pivot arms and toggle links collectively form a toggle mechanism whereby downward movement of the actuator rod 115 will simultaneously swing the tongs about their respective pivot pins to effect opening of the tongs at their clamping arms. Conversely, upward movement of the actuator arm will close or move the clamping arms together to permit gripping of an article between the tong bits 106 and 107 at their respective distal ends.

The tong actuator rod 115 extends upwardly from the pivot block 114 and is connected at its upper end to the lower end of an actuator ram 120 by pin 121 and clevis 122 interiorly of the extension housing 82. The ram is guided for vertical movement in a cylindrical guide 123 which may be rotatably attached to and suspended below the bottom plate 61 as by the aforementioned rotate bearing assembly 81. At its upper end, the ram is operatively connected through a suitable rotational coupling to a ram drive assembly 124 mounted on a mounting plate 125 which is parallel to and spaced above the bottom plate 61 of the frame 60.

The ram drive assembly 124 includes a drive mechanism 128 mounted beneath the mounting plate 125 and to which the ram 120 is drivingly connected. The drive mechanism may be of any suitable type which converts rotary input motion to axial or vertical driving motion of the ram relative to the mounting plate. The rotary input to the drive mechanism is connected to a gear reducer 129 which in turn is connected by coupling 130 to a reversible electric tong actuator motor 131 mounted atop the mounting plate 125 by an upright bracket 132. Also mounted on the upright bracket 132 is an electrically operated tong holding brake 133 which is operatively connected to the motor 131.

The mounting plate 125 which supports the ram drive assembly 124 is mounted in the frame 60 for vertical movement towards and away from the bottom plate 61 and further is supported on the bottom plate by coil springs 140 and 141. The coil springs 140 and 141 are disposed between the bottom plate and mounting plate and about cylindrical spacers 142 and 143 which laterally locate the coil springs and provide an abutment stop for the mounting plate to preclude overcompression of the springs. Upward movement of the mounting plate also is limited by resilient adjustable stops 144 and 145. The stops 144 and 145 each include a stack of bell washers 146 and 147 positioned on vertical rods 148 and 149 between the mounting plate and stop nuts 150 and 151 which are adjustably threaded on the rods 148 and 149, respectively. Each rod passes downwardly through the mounting plate and respective spacer and has its lower end anchored to the bottom plate as seen at 152.

As will be appreciated, upward driving movement of the ram 120 by the drive mechanism 124 will effect closing movement of the tongs 88 and 89 at their clamping arms 104 and 105. When the clamping arms encounter an obstruction such as an article therebetween, the springs 140 and 141 will resiliently and forceably urge the tongs against the article to effect gripping thereof. That is, reactionary forces acting through the drive mechanism 128 on the mounting plate 125 will cause the mounting plate to move towards the bottom plate 61 and the springs 140 and 141 to compress in proportional relation to the gripping forces being exerted by the tongs on the article being gripped therebetween. Accordingly, the degree of spring compression will be less for low gripping forces and greater for high gripping forces. It also is noted that load on or current drawn by the tong grip motor 131 also will be proportionally related to the gripping forces applied at the tong bits. Moreover, it is noted that the tong grip motor may be interrupted or stopped and the holding brake 133 operated or set to hold the springs compressed and thus the tongs against the article thereby to maintain applied gripping force.

In FIG. 6, control circuitry for the grab assembly 50 is schematically shown and indicated generally by reference numeral 160. The control circuitry comprises a tong rotate panel 161 and a tong grip panel 162 which may be conveniently located in the aforementioned operator cage 29 here schematically outlined by broken lines 163. The panels 161 and 162 are respectively connected to the tong rotate motor 83 and tong grip motor 131 by respective cables 164 and 165 which are cabled through a common cable reel device 166. Each control panel contains suitable circuitry for operating the respective motors and both may receive operator control inputs from a joystick master control 167. Also cabled through the cable reel device 166 is a cable 168 which connects the tong grip holding brake 133 to circuitry in the tong grip panel 162.

The control circuitry 160 further comprises a set of three current relays 170–172 and an operator controlled grip selector switch 173 for rendering operative any selected one of the relays. When selected, each relay operates to effect interruption or stoppage of the tong grip motor 131 and setting of the holding brake 133 upon motor current reaching a respective predetermined value. Since the gripping force applied to an article at the tong bits is proportionally related to motor current as above indicated, the relays accordingly operate to limit gripping force to respective predetermined values corresponding to the respective values of motor current which effects activation of such relays.

The activation currents for the relays 170–172 may be selected to provide, for example, low, medium and high gripping forces at the tong bits, respectively. The low gripping force may correspond to that desired for picking up molds with pick-up lugs while preventing or minimizing damage to the mold. On the other hand, the medium gripping force may be used when picking up hot ingots while reducing tong bit indentation and the high gripping force for picking up cold ingots to provide a secure grip on the relatively hard cold metal. Although three relays may provide sufficient selectability for most applications, any number of relays may be provided along with a suitable selector for more or less variability in grip force selection. In each case, the relays and selector may be connected in or to the tong grip panel in any suitable manner providing the above operational functions thereof.

The control circuitry 160 also includes a set of three limit switches 180–182 which respectively correspond to the relays 170–172 as will be seen below. Like the relays, the limit switches are operable to effect stoppage of the tong grip motor 131 and setting of the holding brake 133 upon activation or, more accurately, actuation. Such actuation, however, is effected by mechanical means in the manner described below. At any one time, only one of the limit switches is rendered operative along with a corresponding relay by the selector switch 173. As will be seen below, the switches are located remote from the tong grip panel 162 with connection thereto being provided by a cable 183 which is cabled through a cable reel device 184.

Figure 7:
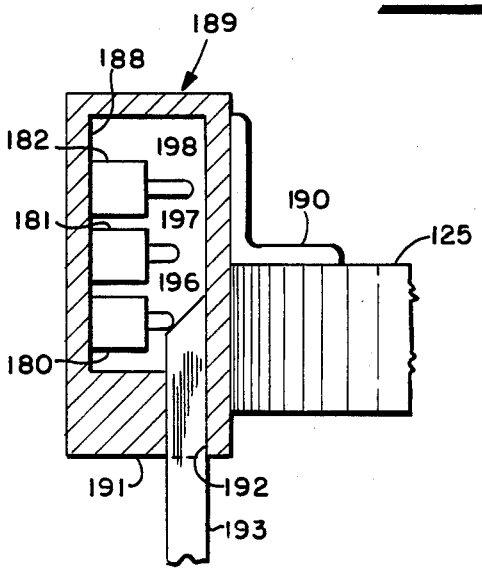
FIG. 7 is an enlarged fragmentary sectional view taken along the line 7—7 of FIG. 5.
Figure 5:
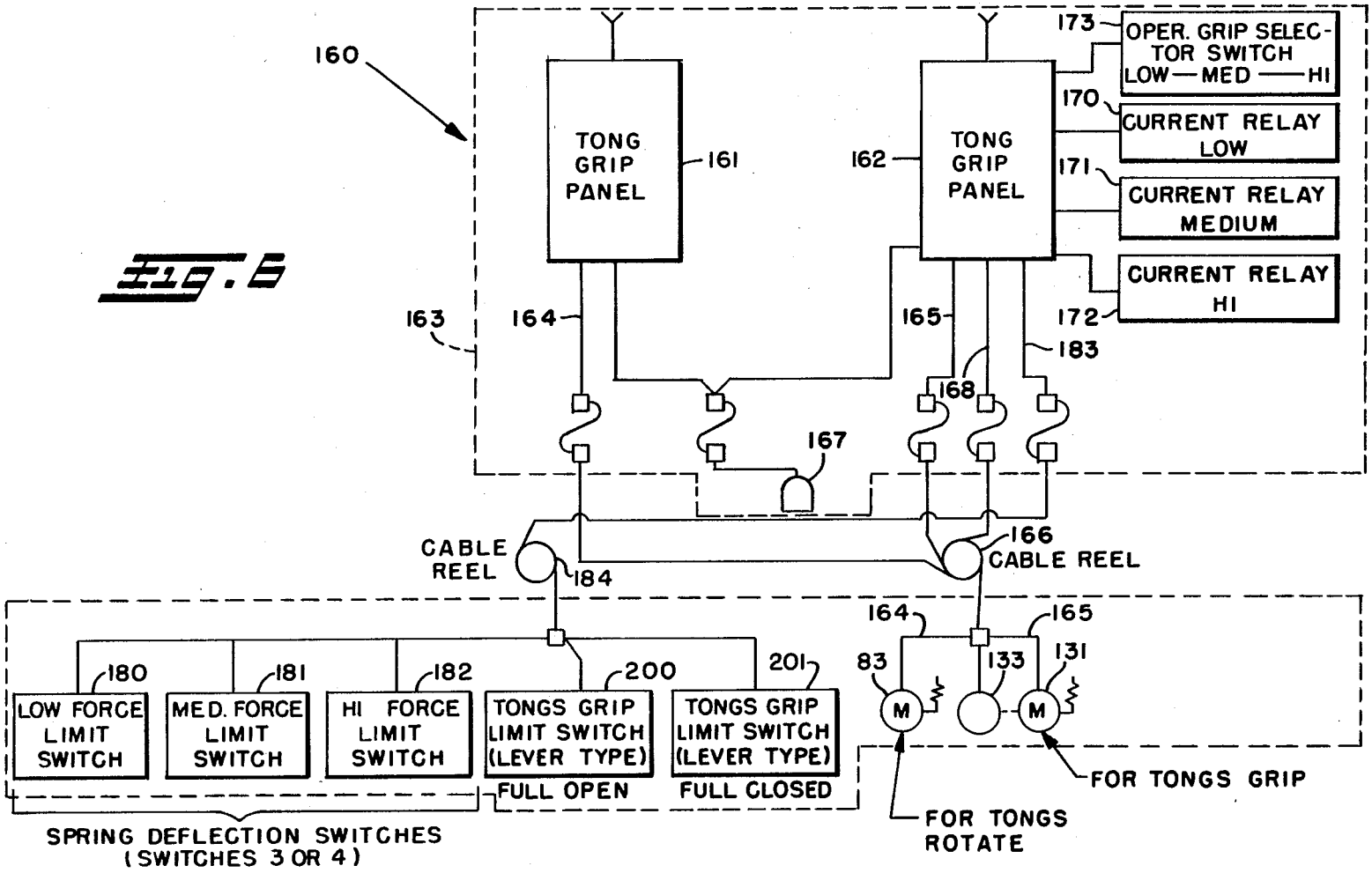

As seen in FIG. 7, the limit switches 180–182 are secured in vertically staggered relationship to the inside vertical wall 188 of a switch housing 189. The switch housing is mounted by an angle bracket 190 to the mounting plate 125 at one edge thereof as further seen in FIGS. 3–5. The bottom wall 191 of the housing has a bore 192 in which a switch actuator rod 193 is guided for vertical, laterally offset movement relative to the switches 180–182. As seen in FIGS. 3 and 4, the actuator rod is fixed at its lower end to the bottom plate 61 of the frame 60. With this arrangement, movement of the mounting plate toward and away from the bottom plate will effect corresponding movement of the switches relative to the actuator rod.

As further seen in FIG. 7, the limit switches have respective laterally extending actuator buttons 196–198 which are normally biased into the vertical path of the actuator rod 193. The buttons are vertically staggered for sequential actuation by the actuator rod during downward movement of the mounting plate 125 and compression of the mounting plate support springs 140 and 141. That is, the lowermost switch 180 will first be actuated, then the second and finally the third at corresponding degrees of spring compression. Since spring compression is proportionally related to the tong grip force as above indicated, the switches will be actuated upon attainment of corresponding and increasingly greater grip forces, respectively. In particular, the switches may be positioned so that the actuation thereof occurs simultaneously or approximately at the same time as activation of the corresponding relays to provide redundant limiting control of tong grip force to desired low, medium and high grip forces.

Two additional limit switches 200 and 201 (FIG. 6) also may be provided to limit maximum opening and closing movements of the tongs. Each limit switch may be of the lever type and mounted in any suitable manner in the tong assembly for actuation upon the tongs reaching their full open and closed positions, respectively. The switches are operatively connected to the tong grip panel by the cable 183 and operate upon actuation to stop the tong grip motor 131 and set the holding brake 133.

In operation and with reference to FIG. 1, the bridge 11 may be moved along the tracks 16 and 17 and the trolley 36 along tracks 27 and 28 until the grab assembly 50 is suspended over an article to be lifted. The grab assembly then may be lowered with the tongs 88 and 89 sufficiently open to receive an article therebetween. With the grip selector switch 173 set by the operator for the desired gripping force, a tong grip motor control switch in the tong grip panel 162 then may be moved to a closed position to energize the tong grip motor 131 for closing of the tongs. When the tongs encounter the article to be handled, the coil springs 140 and 141 will start to compress and resiliently urge the tongs against the article with increasing gripping force while the tong grip motor continues to operate. Motor current through the relay 170, 171 or 172 then selected by the selector switch will increase until such relay is activated, such activation stopping the grip motor and setting the tong holding brake 133. This will be at a time when the springs have sufficiently compressed to produce the selected grip force. Depending on which relay is rendered operative by the selector, the grip force will be low, medium or high.

For redundant grip force control, the amount of compression of the springs will be monitored by the then selected one of the limit switches 180–182, such switch being actuated upon the springs being compressed an amount corresponding to the selected grip force. Accordingly, either one of the control limits will stop the grip motor and set the holding brake. The springs stay at the desired compression distance and produce the selected grip force at the tong bits.

Once the article is gripped by the tongs 88 and 89, the grab lift motor 40 may then be activated to rotate the lifting drum 37 to effect upward hoisting movement of the grab assembly 50 and the article carried thereby. As the article is hoisted and moved to its destination, it can be rotated clockwise or counterclockwise by operation of the rotate motor 83. When located above its destination, the article may be lowered to its desired new position through reverse operation of the grab lift motor. At this point, the tongs may be opened by disengaging the holding brake 133 and operating the tong grip motor 131 in reverse direction to release compression of the springs 140 and 141 and effect opening of the tongs.

In view of the foregoing, a principal advantage of the mechanism used herein is that a single mechanism may be utilized to handle articles having different material and/or constructional characteristics such as hot ingots, cold ingots and ingot molds, while providing a positive grip with a minimum of damage or indentation to the article being handled.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A gripping mechanism comprising complemental article engaging members mounted for movement towards and away from one another, powered means for relatively moving said members forceably to grip an article, holding means operable to maintain applied gripping force, multiple limit means operable to effect such operation of said holding means in response to gripping force reaching respective predetermined values, and selector means for rendering operative any selected one of said limit means, said powered means including an electric motor, and said multiple limit means including respective relay means selectively operably connectable in circuit with said motor by said selector means for monitoring motor current and effecting operation of said holding means in response to respective loads on said motor.

2. The gripping mechanism of claim 1, wherein said holding means includes an electrically operated brake.

3. The gripping mechanism of claim 2, wherein each said relay means is operable to stop said motor in response to the respective load on said motor.

4. The gripping mechanism of claim 1, wherein there are three said limit means delimiting high, medium and low gripping forces, respectively.

5. The gripping mechanism of claim 1, further comprising spring means interconnected between said motor and said members for resiliently urging said members against the article gripped thereby.

6. The gripping mechanism of claim 5, further comprising multiple limit switch means mechanically actuatable in response to respective degrees of compression of said spring means, each said limit switch means being selectively operably connectable by said selector means to said holding means for effecting operation of said holding means upon actuation.

7. The gripping mechanism of claim 6, wherein selective connection of corresponding relay means and limit switch means is effected by said selector means in pairs.

8. The gripping mechanism of claim 1, further comprising spring means drivingly interconnected between said powered means and said members for resiliently urging said members against the article gripped thereby.

9. A gripping mechanism comprising complemental article engaging members mounted for movement towards and away from one another, powered means for relatively moving said members forceably to grip an article, holding means operable to maintain applied gripping force, multiple limit means operable to effect such operation of said holding means in response to gripping force reaching respective predetermined values, selector means for rendering operative any selected one of said limit means, and spring means drivingly interconnected between said powered means and said members for resiliently urging said members against the article gripped thereby, said multiple limit means including respective limit switch means mechanically actuable in response to respective degrees of compression of said spring means, each said limit switch means being selectively connectable by said selector means to said holding means for effecting operation of said holding means upon actuation.

10. A gripping mechanism comprising a tong support structure, a pair of tongs mounted to said tong support structure for movement towards and away from one another, an electric motor mounted with respect to said tong support structure for relatively moving said members towards one another forceably to grip an article therebetween, an electrically operated brake means operable when actuated to prevent relative movement of said tongs away from one another thereby to maintain then existing gripping force, power supply line means for supplying electric current to said electric motor, plural load sensing relay means operably associated with said power supply line means for effecting operation of said brake means in response to respective different predetermined currents in said power supply line means, relay selector means for selecting any one of said load sensing relay menas to be operative in response to the respective predetermined current in said power supply line means to effect actuation of said brake means.

11. The gripping mechanism of claim 10, wherein each said relay means is operable to stop said motor in response to the respective predetermined current in said power supply line means.

12. The gripping mechanism of claim 10, comprising an axially reciprocating tong actuator rod, connection means operatively interconnecting said actuator rod and tongs to actuate said tongs upon axial movement of said tong actuator rod, a motor support mounted for movement relative to said tong support structure, said electric motor being mounted to said motor support, driving connection means operatively connecting said electric motor to said actuator rod axially to move said rod relative to said motor support, spring means interconnected between said motor support and tong support structure for supporting said motor support normally at a first position relative to said tong support structure, said spring means being resiliently yieldable to permit movement of said motor support relative to said tong support in response to movement of said tongs being stopped by engagement of an article therebetween, such movement of said motor support displacing said motor support from said first position by a distance proportionally related to the gripping force of said tongs against the article therebetween, said brake means being operable when actuated to prevent axial movement of said tong actuator rod relative to said motor support, plural limit switch means mounted to one of said motor support and tong support, and the other of said motor support and tong support having mounted thereto a switch actuator, and switch selector means for selecting any one of said limit switch means to be operative to actuate said brake means in response to the selected switch means being actuated by said switch actuator, said switch actuator being positioned with respect to said plural limit switch means for sequential actuation of said plural limit switch means at respective different positions of said motor support relative to said tong support.

13. The gripping mechanism of claim 12, wherein said relay selector means and switch selector means including a common switch for paired selection of corresponding relay means and limit switch means.

14. A gripping mechanism comprising complemental article engaging members mounted for movement towards and away from one another, an electric motor for relatively moving said members forceably to grip an article, spring means interconnected between said electric motor and said members for resiliently urging said members against the article gripped thereby, holding means operable to maintain the applied gripping force, plural current monitoring means operably connected in circuit with said motor for monitoring motor current and effecting operation of said holding means in response to respective different predetermined currents, plural limit switch means mechanically actuable in response to respective different predetermined degrees of compression of said spring means for effecting operation of said holding means upon mechanical actuation, each one of a plurality of said current monitoring means being paired with a respective one of said plural limit switch means, and selector means for selecting any one of such pairs of current monitoring means and limit switch means to be operative for effecting actuation of said holding means.

15. The gripping mechanism of claim 14, wherein each said current monitoring means also is operative to stop said motor in response to the respective current to the motor.

16. The gripping mechanism of claim 15, wherein each said limit switch means also is operative to stop said motor in response to the respective degree of compression of said spring means.

17. The gripping mechanism of claim 14, wherein said holding means includes an electrically operated brake.

18. The gripping mechanism of claim 17, wherein said article engaging members include tongs mounted for swinging movement about horizontal axes fixed relative to a frame, and said motor is supported on said frame by said spring means.

19. The gripping mechanism of claim 18, comprising toggle means for effecting simultaneous swinging movement of said tongs about said axes, axially movable means for actuating said toggle means, and means connecting said motor to said axially movable means for effecting axial movement of the latter relative to the motor.

* * * * *